US005518381A

United States Patent [19]

Matsunaga et al.

[11] Patent Number: 5,518,381

[45] Date of Patent: May 21, 1996

[54] CLOSED ROTARY COMPRESSOR

[75] Inventors: Hiroshi Matsunaga, Kusatsu; Shinji Fujiwara, Otsu; Hirotsugu Fukuoka, Kusatsu; Keisuke Morita, Otsu; Yasuhiko Sano, Moriyama, all of Japan

[73] Assignee: Matsushita Electric Industrial Co., Ltd., Osaka, Japan

[21] Appl. No.: 361,031

[22] Filed: Dec. 21, 1994

[30] Foreign Application Priority Data

Dec. 24, 1993 [JP] Japan ..... 5-328512

[51] Int. Cl.[6] ..... F01C 21/04

[52] U.S. Cl. ..... 418/100; 418/60; 418/212

[58] Field of Search ..... 418/13, 60, 63, 418/97, 100, 212

[56] References Cited

U.S. PATENT DOCUMENTS

| | | | |
|---|---|---|---|
| 5,181,414 | 1/1993 | Baret et al. | 418/100 |
| 5,322,424 | 6/1994 | Fujio | 418/60 |

FOREIGN PATENT DOCUMENTS

| | | | |
|---|---|---|---|
| 57-173589 | 10/1982 | Japan . | |
| 0291488 | 12/1987 | Japan | 418/100 |
| 0300083 | 12/1989 | Japan | 418/60 |

*Primary Examiner*—Charles Freay

*Attorney, Agent, or Firm*—Wenderoth, Lind & Ponack

[57] ABSTRACT

A closed rotary compressor includes a generally cylindrical sealed vessel having an oil sump defined therein for accommodating a quantity of lubricating oil, a drive unit housed within the sealed vessel and having a drive motor and a shaft driven by the drive motor, and a compressor mechanism housed within the sealed vessel. The compressor mechanism is provided with at least one set of compression elements. This set of compression elements is made up of a cylinder having a compression compartment and a refrigerant intake port both defined therein in communication with each other, first and second bearings secured to the lower and upper end surfaces of the cylinder, respectively, for rotatably supporting the shaft, a crank provided on the shaft for rotation together therewith, a ring-shaped roller encircling the crank and capable of undergoing a planetary motion in contact with the crank during rotation of the crank, and a radial vane slidably accommodated in the cylinder for reciprocating movement in a direction radially of the cylinder. The radial vane has a radial inner end held in sliding contact with an outer peripheral surface of the ring-shaped roller, to thereby divide the compression compartment into a suction chamber and a compression chamber. An oil passage is provided in the compressor mechanism to place the oil sump in communication with the refrigerant intake port. The oil passage has a throttled portion at a location adjacent to the refrigerant intake port.

12 Claims, 12 Drawing Sheets

CLOSED ROTARY COMPRESSOR

BACKGROUND OF THE INVENTION

1. Field of the Invention

The present invention relates to a closed rotary compressor and, more particularly, to the closed rotary compressor of a type suited for use in a refrigerator, an air-conditioner or the like for compressing refrigerant gas.

2. Description of Related Art

The closed rotary compressor is well known in the art, an example of which is shown in FIGS. 10 and 11 in longitudinal and transverse sectional representations, respectively, for discussion of the prior art believed to be relevant to the present invention.

The closed rotary compressor shown in FIGS. 10 and 11 includes a generally cylindrical sealed vessel 1 tightly closed at its opposite ends and accommodating therein an electric motor 2 comprised of a stator 2-1 and a rotor 2-2. This sealed vessel 1 also accommodates therein a compressor mechanism 3 positioned beneath the electric motor 2 and adapted to be driven by the electric motor 2. While the compressor mechanism 3 is driven, a refrigerant introduced into the compressor mechanism 3 from an intake port 5 through an accumulator (not shown) and an intake tube 4 is compressed. The resultant compressed refrigerant is discharged into the sealed vessel 1 through an outlet port 6 and then therefrom to a refrigerating circuit through a discharge tube 7 disposed at an upper portion of the sealed vessel 1.

The compressor mechanism 3 of the prior art rotary compressor comprises, as best shown in FIGS. 10 and 11, a shaft 8 adapted to be driven by the electric motor 2 and having its upper and lower ends rotatably received by main and auxiliary bearings 9 and 11, respectively, a generally intermediate portion of said shaft 8 extending through a cylinder 10 fixed in position inside the sealed vessel 1. A crank (eccentric portion) 12 is fixedly mounted on, or otherwise formed integrally with, a portion of the shaft 8 situated within the cylinder 10 for rotation together therewith. A ring-shaped roller 13 is operatively positioned between an inner wall surface of the cylinder 10 and an outer peripheral surface of the crank 12 and will, while the shaft 8 is driving, undergo a planetary motion.

As best shown in FIG. 11, the cylinder 10 has a radial groove 22 defined therein so as to extend in a direction radially thereof, and a slidable radial vane 14 is accommodated within the radial groove 22 for movement within the radial groove 22 in a direction towards and away from the roller 13. This slidable radial vane 14 is normally biased by a biasing spring 15 in one direction with a radially inward end thereof held in sliding contact with an outer peripheral surface of the ring-shaped roller 13, thereby dividing the volume of the cylinder 10 into volumetrically variable, suction and compression chambers 16 and 17 that are defined, respectively on leading and trailing sides of the slidable radial vane 14 with respect to the direction of rotation of the shaft 8.

According to the prior art closed rotary compressor shown in FIGS. 10 and 11, refrigerant gas is, during the planetary motion of the ring-shaped roller 13 accompanying an eccentric rotation of the crank 12 rigid with the shaft 8, sucked into the suction chamber 16 through the intake port 5 and then compressed before it is discharged through a discharge port 19. In order to facilitate a sliding motion of the ring-shaped roller 13 relative to the inner wall surface of the cylinder 10 and the radial inner end of the slidable radial vane 14 and also a sliding motion of the radial vane 14 within the radial groove 22, a quantity of lubricating oil is accommodated within the sealed vessel 1 at a bottom portion 20 thereof. The lubricating oil is sucked up by an oil pump 21 mounted on the lower end of the shaft 8 to oil various sliding elements within the compressor mechanism 3.

Of the various sliding elements used in the compressor mechanism 3, the slidable radial vane 14 when noticeably worn out creates a detrimental problem. As is well known to those skilled in the art, the slidable radial vane 14 is frictionally engaged not only with the ring-shaped roller 13, but also with side surfaces defining the radial groove 22 in the cylinder 10. Specifically, by the biasing force of the biasing spring 15 and a back pressure acting on the trailing surface of the slidable radial vane 14, the radial inner end of the slidable radial vane 14 is constantly held in frictional engagement with the ring-shaped roller 13 and, also, by the effect of a pressure difference between the suction and compression chambers 16 and 17, opposite side surfaces of the slidable radial vane 14 are alternately held in frictional engagement with the corresponding side surfaces defining the radial groove 22. Unlike other sliding elements such as, for example, the shaft 8 and its bearing mechanism, the slidable radial vane 14 is not lubricated by the lubricating oil supplied directly by the oil pump 21, but is lubricated by an oil component, contained in the refrigerant being compressed, and/or an oil leaking from roller ends. The quantity of the oil available from the refrigerant being compressed and leaking from the roller ends is indeed insufficient for lubricating the slidable radial vane 14 and its surrounding parts satisfactorily. In addition, considering that the refrigerant when compressed reaches an elevated temperature, the slidable radial vane 14 in contact with the refrigerant being compressed is heated and is therefore susceptible to an accelerated frictional wear.

In order to eliminate the above discussed problems, Japanese Laid-open Patent Publication (unexamined) No. 57-173589 suggests the use of an oil injector mechanism 51 as shown in FIG. 12.

The oil injector mechanism 51 includes an oil supply tube 52 composed of a capillary tube and installed at a lower portion of the cylinder 10, with one end thereof immersed in the lubricating oil such that the oil supply tube 52 communicates with the intake port 5. The oil injector mechanism 51 also includes a valve 53 for opening and closing an upper open end of the oil supply tube 52 by a pressure difference, and a coil spring 57 for biasing the valve 53 downwardly.

The biasing force of the coil spring 57 is so chosen as to be greater than the pressure in the sealed vessel 1 during a normal operation but smaller than the pressure in the sealed vessel 1 during an abnormal operation in which the pressure in the sealed vessel 1 is abnormally high. During the abnormal operation, the ring-shaped roller 13 and the slidable radial vane 14 are likely to wear due to a high load. In order to prevent the roller 13 and the vane 14 from wearing, the lubricating oil stored at the bottom of the sealed vessel 1 is introduced into the intake port 5 by means of a pressure difference and is mixed with the refrigerant gas to lubricate the surfaces of the roller 13 and the vane 14. On the other hand, during the normal operation, this construction prevents high-temperature oil from entering the intake path to lower the efficiency of the compressor.

For the refrigerant used in the refrigerating system including the closed rotary compressor, dichlorodifluoromethane (hereinafter referred to as "CFC 12") or hydrochlorofluoromethane (hereinafter referred to as "HCFC 22") is generally used. On the other hand, the lubricating oil in the compressor mechanism 3 is generally either a mineral oil of naphthene or that of paraffin having a solubility with CFC 12 or HCFC 22.

Since the refrigerant and the lubricating oil circulate directly within the sealed vessel 1, the various component parts of the compressor mechanism 3 must have a sufficient resistance to wear.

Apart from the above, it has come to be recognized that the emission of Freon, used as the refrigerant into the atmosphere does not only seriously damage the ozone layer, but brings about global ecological damage. In view of this, an international agreement has been made to step by step freeze for some years ahead and eventually abolish the production of CFC 12 and HCFC 22. Under these circumstances, as a substitute refrigerant, 1,1,1,2-tetrafluoroethane (hereinafter referred to as "HFC 134*a*"), 1,1 difluoroethane (hereinafter referred to as "HFC 152*a*" and hydrodifluoromethane (hereinafter referred to as "HFC 32") or a mixture thereof have been developed.

While the substitute refrigerant such as HFCs 134*a*, 152*a* and 32 is less likely to result in damage of the ozone layer, it lacks a solubility with such a mineral lubricant as hitherto used in combination with the CFC 12 or HCFC 22. For this reason, where the substitute refrigerant is to be used in the refrigerating system, attempts have been made to use such a lubricant oil of ether, ester or fluorine family which has a compatibility with the substitute refrigerant.

However, where a combination of any one of the HFCs 134*a*, 152*a* and 32 in place of any of the CFC 12 and HCFC 22 with either polyalkylene glycol oil or polyester oil having a compatibility with such substitute refrigerant is used in the refrigerant compressor, it has been found that the resistance to frictional wear of such metallic material as FC25, special cast iron, sintered alloy and stainless steel used for sliding elements in the refrigerant compressor tends to be lowered and, therefore, the refrigerant compressor cannot be operated stably for a long period of time. This is because of the following reasons.

So long as the conventional CFC 12 or HCFC 22 is used as the refrigerant, chlorine atoms contained in the conventional refrigerant react with Fe atoms contained in the metal matrix to form a film of ferric chloride that is excellent in resistance to frictional wear. However, in the case of the substitute refrigerant such as HFC 134*a*, HFC 152*a* or HFC 32, no chlorine atoms exist in this compound and, therefore, no lubricating film such as a film of ferric chloride is formed, accompanied by a reduction in lubricating action.

In addition, while the conventional mineral oil used as a lubricant contains a cyclic compound and has therefore a relatively high capability of forming an oil film, the lubricating oil compatible with the substitute refrigerant is composed mainly of a chain compound and is therefore unable to form a required oil film under severe sliding conditions, accompanied by an accelerated reduction in resistance to frictional wear.

As discussed above, the refrigerant compressor operable with the substitute refrigerant and the lubricating oil compatible with this substitute refrigerant is often placed under severe sliding conditions not only during a high load drive, but also during a normal drive and, therefore, the frictional wear of the vane and roller has become more pronounced.

In order to cope with the above-described problems, the solution suggested in the previously discussed publication No. 57-173589 may be so modified as to perform oil injection even during the normal drive by weakening the biasing force of the spring or by removing the spring. In this case, however, the intake port is supplied with high-temperature oil, which in turn overheats the refrigerant introduced into the compressor, thus lowering the efficiency of the compressor.

SUMMARY OF THE INVENTION

The present invention has been developed to overcome the above-described disadvantages.

It is accordingly an object of the present invention to provide an improved refrigerant compressor capable of readily forming an oil film between a vane and a roller without lowering the efficiency of the compressor even though the HFC refrigerant is used, to thereby increase the resistance to frictional wear and the lifetime of the compressor.

In accomplishing the above and other objectives, the closed rotary compressor according to the present invention comprises a generally cylindrical sealed vessel having an oil sump defined therein for accommodating a quantity of lubricating oil, a drive unit housed within the sealed vessel and having a drive motor and a shaft driven by the drive motor, and a compressor mechanism housed within the sealed vessel. The compressor mechanism includes a cylinder having a compression compartment and a refrigerant intake port both deemed therein in communication with each other and also having upper and lower end surfaces, first and second bearings secured to the lower and upper end surfaces of the cylinder, respectively, for rotatably supporting the shaft, a crank provided on the shaft for rotation together therewith, a ring-shaped roller encircling the crank and capable of undergoing a planetary motion in contact with the crank during rotation of the crank, and a radial vane slidably accommodated in the cylinder for reciprocating in a direction radially of the cylinder. The radial vane has a radial inner end held in sliding contact with an outer peripheral surface of the ring-shaped roller, to thereby divide the compression compartment into a suction chamber and a compression chamber. An oil passage means is provided in the compressor mechanism for placing the oil sump in communication with the refrigerant intake port, and has a throttled portion at a location adjacent to the refrigerant intake port.

Conveniently, the oil passage means comprises a holder secured to either the first bearing or the cylinder. The holder has a capillary passage defined therein, which constitutes the throttled portion.

Advantageously, the oil sump accommodates a lubricating oil having a solubility with HFC refrigerant.

Alternatively, the compressor mechanism may have first and second sets of compression elements. In this case, the ring-shaped rollers of the first and second sets have respective rotational phases which differ by 180°. The cylinder of the first set has a first refrigerant intake port defined therein in communication with the compression compartment thereof, and also has a branch port defined therein and branched from the first refrigerant intake port. A partition plate having a communication hole defined therein in communication with the branch port is interposed between the cylinder of the first set and that of the second set. The cylinder of the second set has a second refrigerant intake port defined therein in communication with the communication hole of the partition plate. The first and second bearings are secured to the lower end surface of the cylinder of the first set and to the upper end surface of the cylinder of the second set, respectively, for rotatably supporting the shaft. The closed rotary compressor of this construction includes an oil passage means located upstream of the branch port with respect to the direction of flow of refrigerant to place the oil sump in communication with the first refrigerant intake port.

The oil passage means may place the oil sump in communication with the communication hole of the partition plate.

In general, sliding elements provided in the compressor mechanism are lubricated by a lubricating oil supplied from an oil pump. However, during the normal drive of the compressor employing HFC refrigerant, the above-described construction enables the throttled portion to mix an appropriate amount of oil with refrigerant introduced into the compressor according to the magnitude of the load in the presence of a pressure difference between the refrigerant intake port and the oil sump. Such oil forms an oil film having an appropriate thickness particularly between the radial vane and the ring-shaped roller.

The oil stored in the oil sump and containing the refrigerant passes through the oil passage means and has its pressure reduced by the throttled portion. At this time, the refrigerant vaporizes, thus cooling the oil. Because the cooled oil is quickly introduced into the refrigerant intake port, neither an overheating of the introduced refrigerant nor a reduction in efficiency will occur, resulting in an increase in reliability.

BRIEF DESCRIPTION OF THE DRAWINGS

The above and other objects and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

Figure 1:
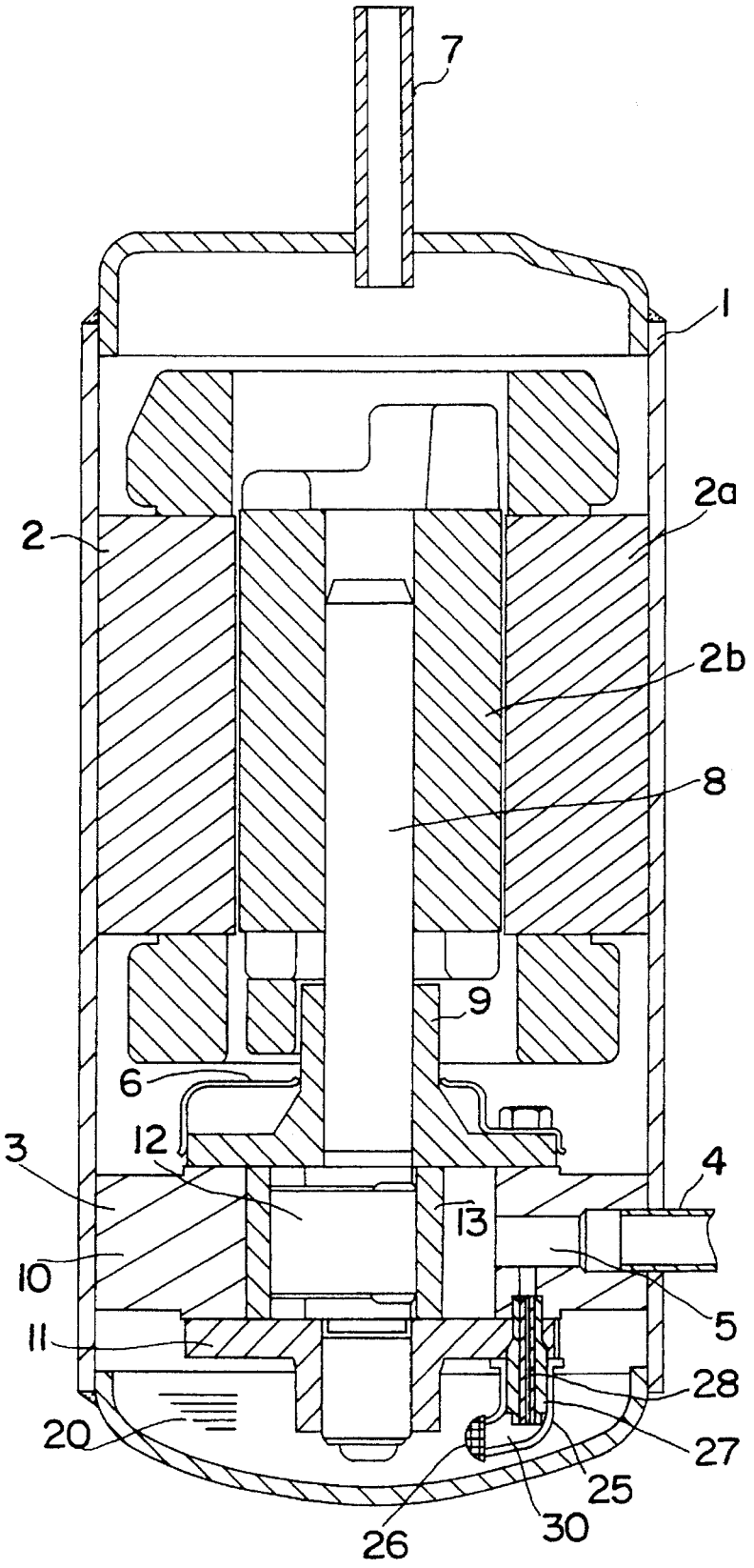
FIG. 1 is a vertical sectional view of a first embodiment of a closed rotary compressor of a type accommodating only one roller according to the present invention.
Figure 4:
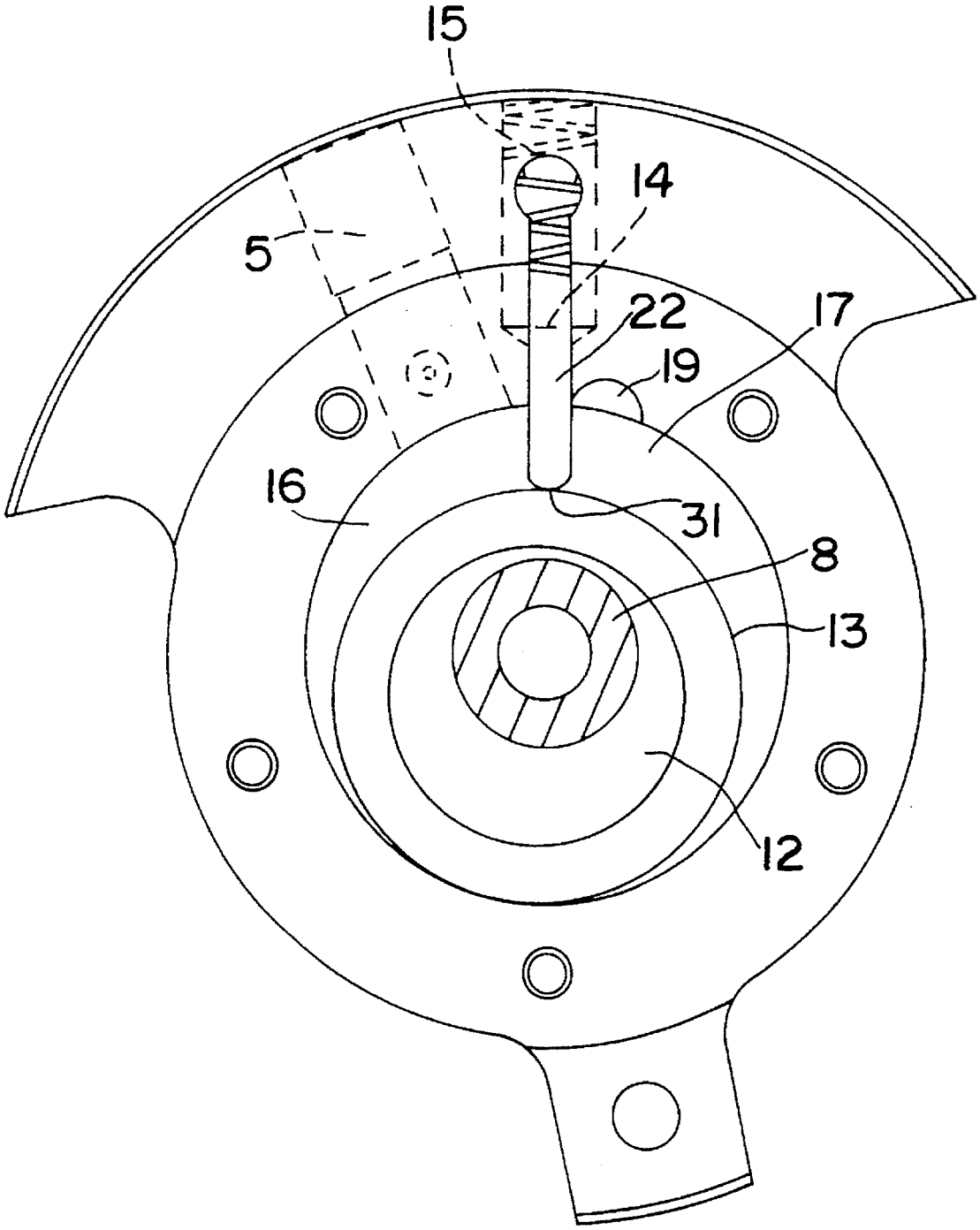
FIG. 4 is a horizontal sectional view, on an enlarged scale, of the compressor of FIG. 1 or 3.

Referring now to the drawings, there is shown in FIGS. 1 and 4 a first embodiment of a closed rotary compressor according to the present invention.

The closed rotary compressor shown in FIGS. 1 and 4 includes a generally cylindrical sealed vessel 1 tightly closed at its opposite ends and accommodating therein an electric motor 2 comprised of a stator 2*a* and a rotor 2*b*. This sealed vessel 1 also accommodates therein a compressor mechanism 3 positioned beneath the electric motor 2 and adapted to be driven by the electric motor 2. A shaft 8, connected directly with the electric motor 2, is carried by a main bearing 9 and an auxiliary bearing 11. An intermediate portion of the shaft 8 extends through a cylinder 10 fixed in position inside the sealed vessel 1. The cylinder 10 has a compression compartment defined therein and also has upper and lower end surfaces to which the main and auxiliary bearings 9 and 11 are secured, respectively. A crank (eccentric portion) 12 is fixedly mounted on, or otherwise formed integrally with, a portion of the shaft 8 situated within the cylinder 10 for rotation together therewith. A ring-shaped roller 13 is operatively positioned between an inner wall surface of the cylinder 10 and an outer peripheral surface of the crank 12 and will, while the shaft 8, undergo a planetary motion.

As best shown in FIG. 4, the cylinder 10 has a radial groove 22 defined therein so as to extend in a direction radially thereof, and a slidable radial vane 14 is accommodated within the radial groove 22 for movement within the radial groove 22 in a direction towards and away from the roller 13. This slidable radial vane 14 is normally biased by a biasing spring 15 and a back pressure (discharge pressure) in one direction with a radially inward end thereof held in sliding contact with an outer peripheral surface of the ring-shaped roller 13, thereby dividing the compression compartment of the cylinder 10 into volumetrically variable, suction and compression chambers 16 and 17 that are defined respectively on leading and trailing sides of the slidable radial vane 14 with respect to the direction of rotation of the shaft 8.

A quantity of lubricating oil is accommodated within the sealed vessel 1 at the bottom thereof so that the entire cylinder 10 may be dipped into the lubricating oil during a normal drive. Mineral oil of naphthene, that of paraffin, or synthetic oil of alkylbenzene is generally used as the lubricating oil in combination with R12 or R22 refrigerant. In the case of the refrigerant of HFC group, oil of the ether group or ester group is used, with which the HYC refrigerant has a solubility. During the normal drive, a considerable quantity of refrigerant is dissolved in the lubricating oil stored at the bottom of the sealed vessel 1 due to the solubility of the former with the latter.

The cylinder 10 has an intake port 5 defined therein so as to extend radially thereof and is connected to an intake robe 4 received in the intake port 5. The cylinder 10 communicates with an accumulator (not shown) via the intake tube 4 and the intake port 5.

Figure 2:
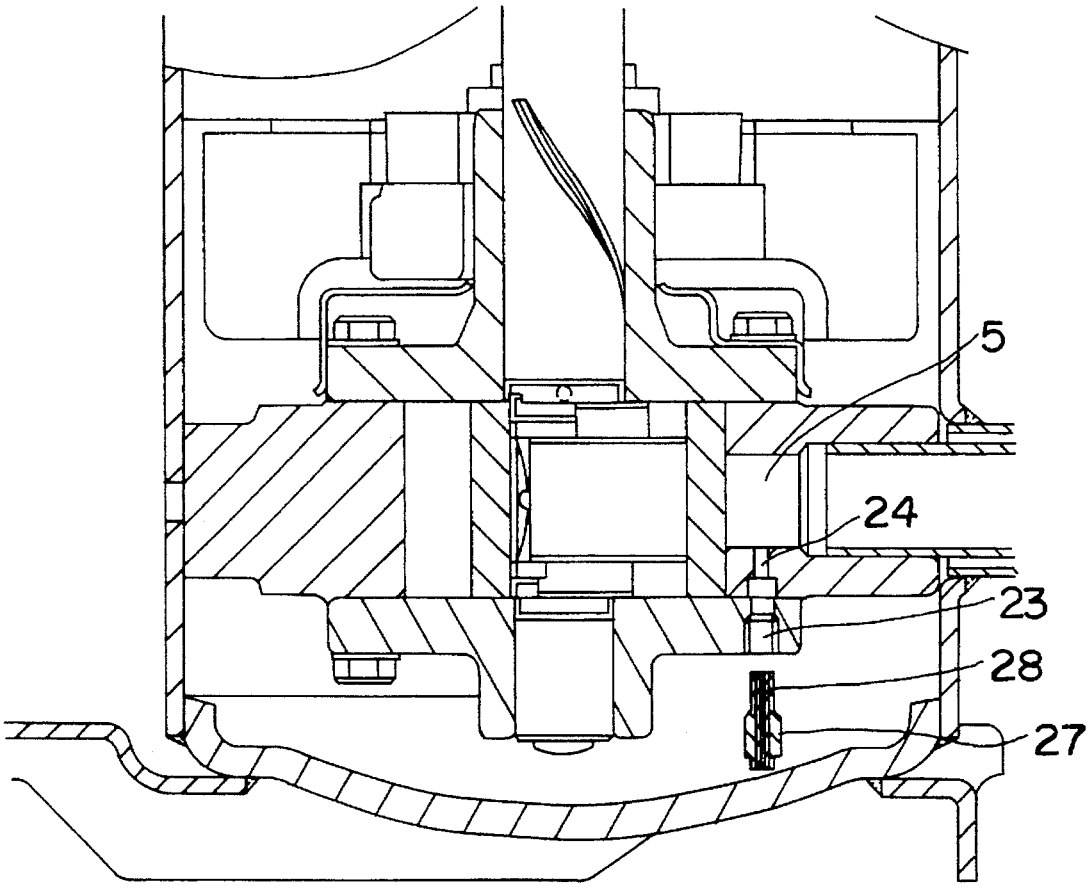
FIG. 2 is a vertical sectional view, on an enlarged scale, of an essential portion of the compressor of FIG. 1.

The intake port 5 communicates with an oil sump 20, formed at the bottom of the sealed vessel 1, via an oil passage 30. As shown in FIG. 1 and FIG. 2, the oil passage 30 is made up of a through-hole 24 defined in the cylinder 10 so as to extend in a direction perpendicular to the direction in which the intake port 5 extends, a generally cylindrical holder 27 having a throttled portion deformed therein, and an oil supply tube 25 encircling the holder 27 and secured to the auxiliary bearing 11 at its upper end. The oil supply robe 25 has a lower end open in the vicinity of the bottom of the sealed vessel 1, and a filter 26 is mounted on the lower end of the oil supply tube 25 to prevent clogging of the throttled portion of the holder 27.

In order to form the throttled portion in the holder 27, a capillary tube 28 is pressed into the holder 27. The capillary tube 28 has a through-hole defined therein which has a diameter less than 1 mm, thus providing a throttling effect. It is possible to form a tiny through-hole directly in the holder 27 instead of pressing the capillary robe into the holder 27. The auxiliary bearing 11 has a through-hole 23 defined therein in line with the through-hole 24 of the cylinder 10. A generally middle portion of the holder 27 is threaded into the through-hole 23 until the upper end of the holder 27 is pressed against the cylinder 10 to provide a sufficient seal therebetween. This construction enables the throttled portion to be disposed in the vicinity of the intake port 5.

The oil supply tube 25 may be omitted when the holder 27 is mounted on the auxiliary bearing 11, because the lower open end of the holder 27 is positioned deep in the oil sump 20.

Figure 3:
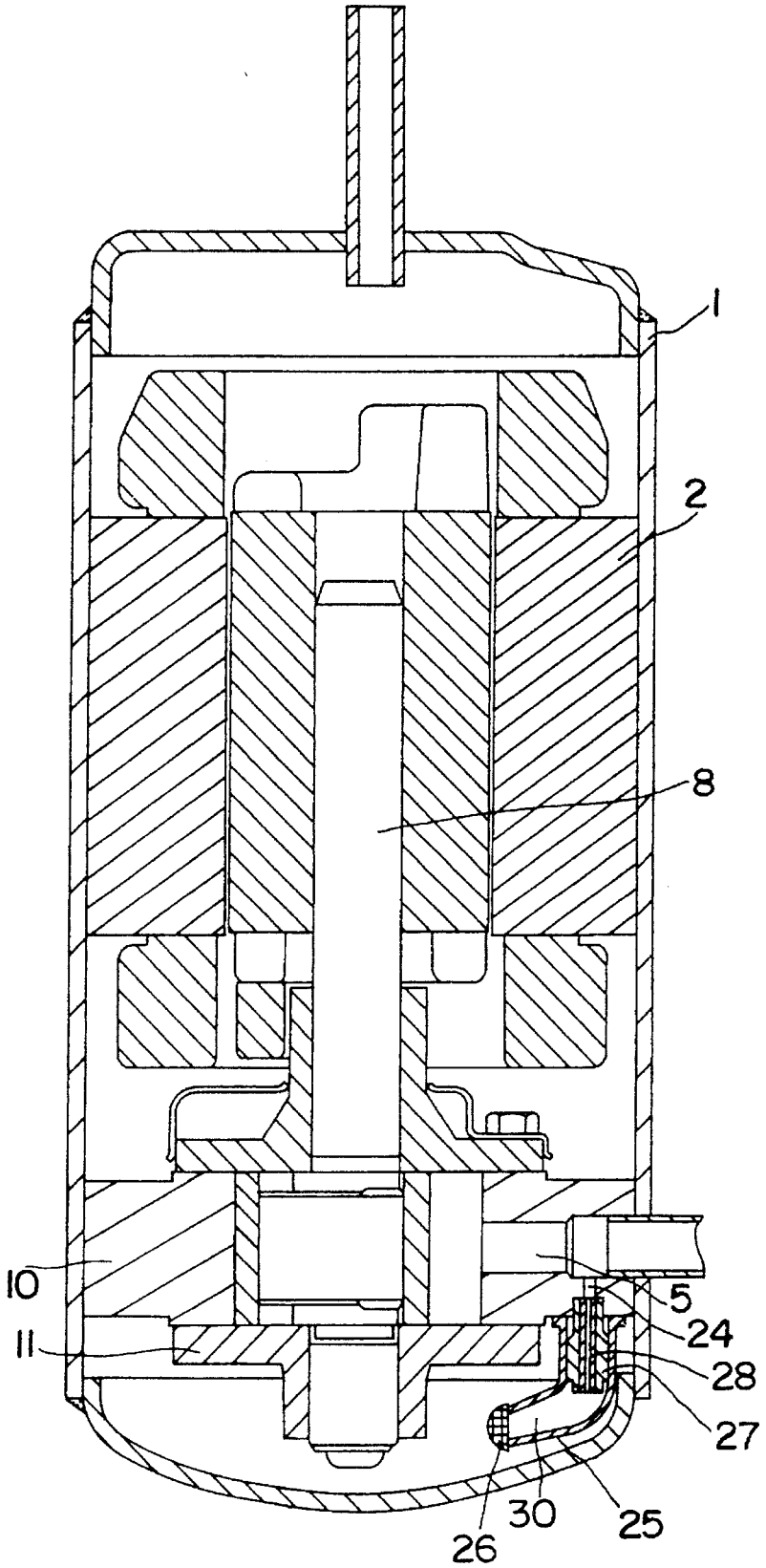
FIG. 3 is a view similar to FIG. 1, but depicting a modification thereof.

FIG. 3 depicts a modification of the embodiment shown in FIGS. 1 and 2. In FIG. 3, the holder 27 having the throttled portion is directly secured to the cylinder 10 and, hence, the throttled portion can be located at a position closer to the intake port 5.

The operation of the compressor having the above-described construction is described below.

When the shaft 8 is driven by the electric motor 2, refrigerant gas such as, for example, HFC is introduced into the suction chamber 16 through the intake tube 4 and the intake port 5 due to the planetary motion of the roller 13. The refrigerant gas is then compressed in the compression chamber 17 and is eventually discharged into the sealed vessel 1 via a discharge port 19 and an outlet port 6. At this time, rite vane 14 partitioning the cylinder 10 into the suction chamber 16 and the compression chamber 17 reciprocates within the radial groove 22 while in sliding contact with the roller 13 at a region 31, with the radially inward end of rite vane 14 pressed against the outer peripheral surface of the roller 13 by the combined force of the biasing spring 15 and the back pressure acting on the vane 14. The region 31 of sliding contact between the radial inner end of the vane 14 and rite roller 13 is mainly lubricated by a slight amount of lubricating oil which is mixed in the refrigerant being sucked through the intake port 5. The quantity of the lubricating oil sucked into the suction chamber 16 of the cylinder 10 together with the refrigerant is so slight that no sufficient lubrication may be accomplished, and this is particularly true where HFC is employed for the refrigerant to be compressed.

As a matter of course, the internal pressure of the intake port 5 is low. A pressure difference between the intake port 5 and the oil sump 20 of a relatively high pressure supplies the lubricating oil to the intake port 5 through the oil supply robe 25 and the throttled portion, with dust being removed by the filter 26. Because the lubricating oil stored in the oil sump 20 is properly selected in consideration of the solubility with the refrigerant to be used, a considerable amount of refrigerant is contained in the lubricating oil. Although the lubricating oil containing the refrigerant has a high temperature and pressure in the oil sump 20, the pressure thereof is reduced by the throttled portion, thereby vaporizing the refrigerant. The heat of vaporization generated at that time cools the lubricating oil, which is in turn sucked into the intake port 5.

In the conventional oil injector mechanism, the pressure of the lubricating oil is reduced in the capillary tube dipped in the oil sump. Accordingly, immediately after the lubricating oil in the capillary robe is cooled, it receives heat from the surrounding high-temperature oil. As a result, oil having the substantially same temperature as the surrounding oil is sucked into the intake port 5, thus causing overheating of the sucked gas and lowering the efficiency of the compressor.

According to the present invention, however, because the throttled portion is positioned close to the intake port 5, the oil does not receive heat from its surroundings. Thus, oil having a reduced temperature is introduced into the intake port 5 and, hence, no reduction in efficiency will occur.

The oil sucked into the intake port 5 is introduced into the suction chamber 16 and is then transferred to the compression chamber 17 by the planetary motion of the roller 13. At this moment, part of the oil lubricates the region 31 of sliding contact between the roller 13 and the vane 14, thus forming an oil film to prevent wear thereof.

The oil which has been sucked into the intake port 5 and has lubricated the sliding elements is discharged, together with the refrigerant gas, into the sealed vessel 1 through the outlet port 6. The oil discharged from the outlet port 6 is thrown off while it passes through cutouts in the electric motor 2, and most of the oil returns to the oil sump 20. In this way, the quantity of the oil which may be circulated through the refrigerating circuit is minimized to avoid any possible reduction in heat exchange efficiency of a heat exchanger while increasing the refrigerating efficiency.

Because the oil sucked into the intake port 5 passes through the throttled portion, the higher the pressure difference, the more the oil is sucked thereinto. Hence, the higher the pressure difference, the more the lubricating oil is introduced into the sliding region 31, accompanied by an increase in reliability.

While in the foregoing description, reference has been made to the use of the HFC refrigerant being compressed, the present invention is not limited to the use of the HFC refrigerant and may be equally applicable to the use of any other conventional refrigerant such as HCFC 22. Even where such conventional refrigerant is employed as the refrigerant being compressed in the rotary compressor, effects similar to those discussed above can be obtained.

Figure 5:
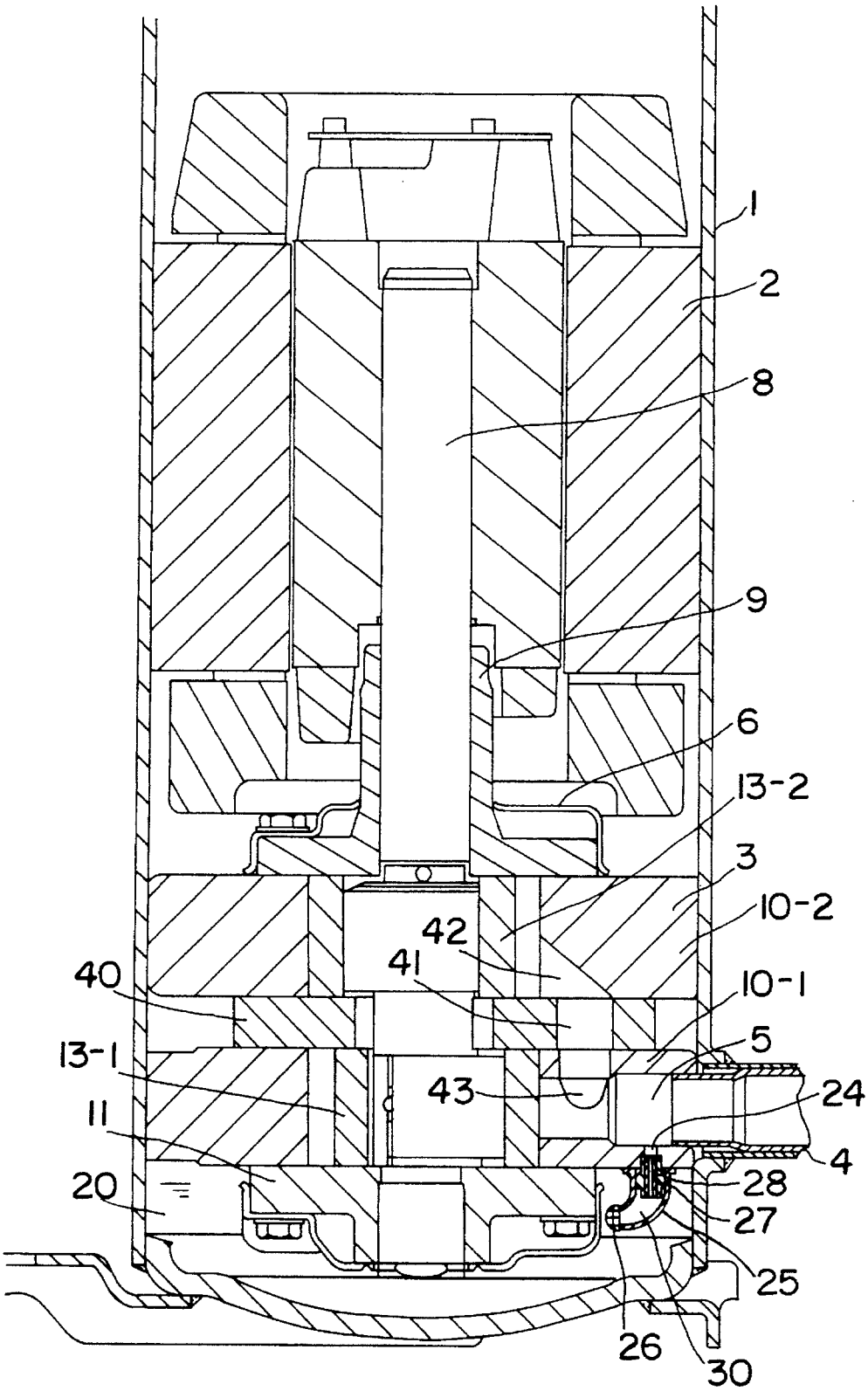
FIG. 5 is a view similar to FIG. 1, but showing a second embodiment of a closed rotary compressor of a type accommodating two rollers according to the present invention.
Figure 6:
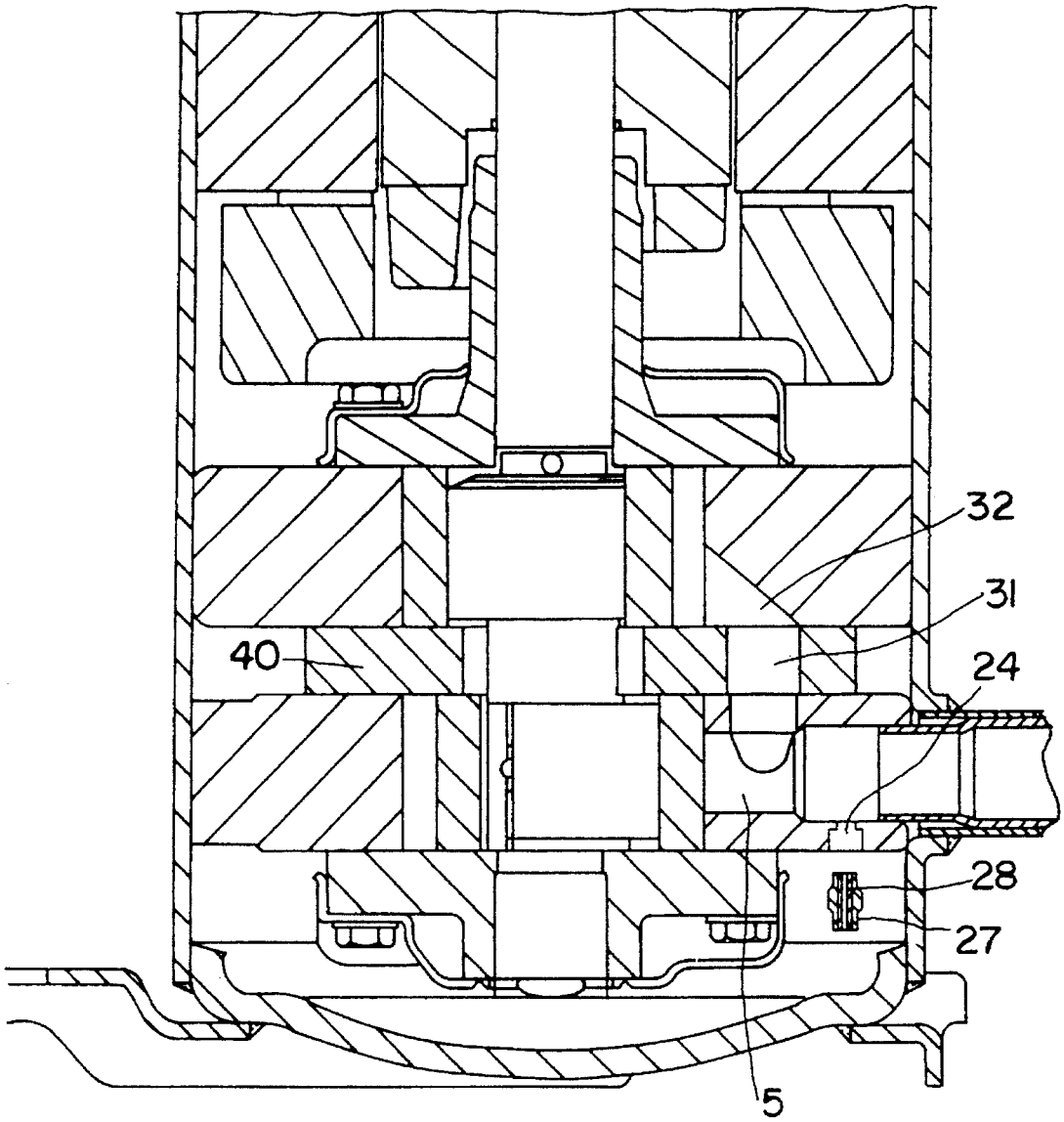
FIG. 6 is a vertical sectional view, on an enlarged scale, of an essential portion of the compressor of FIG. 5.
Figure 8:
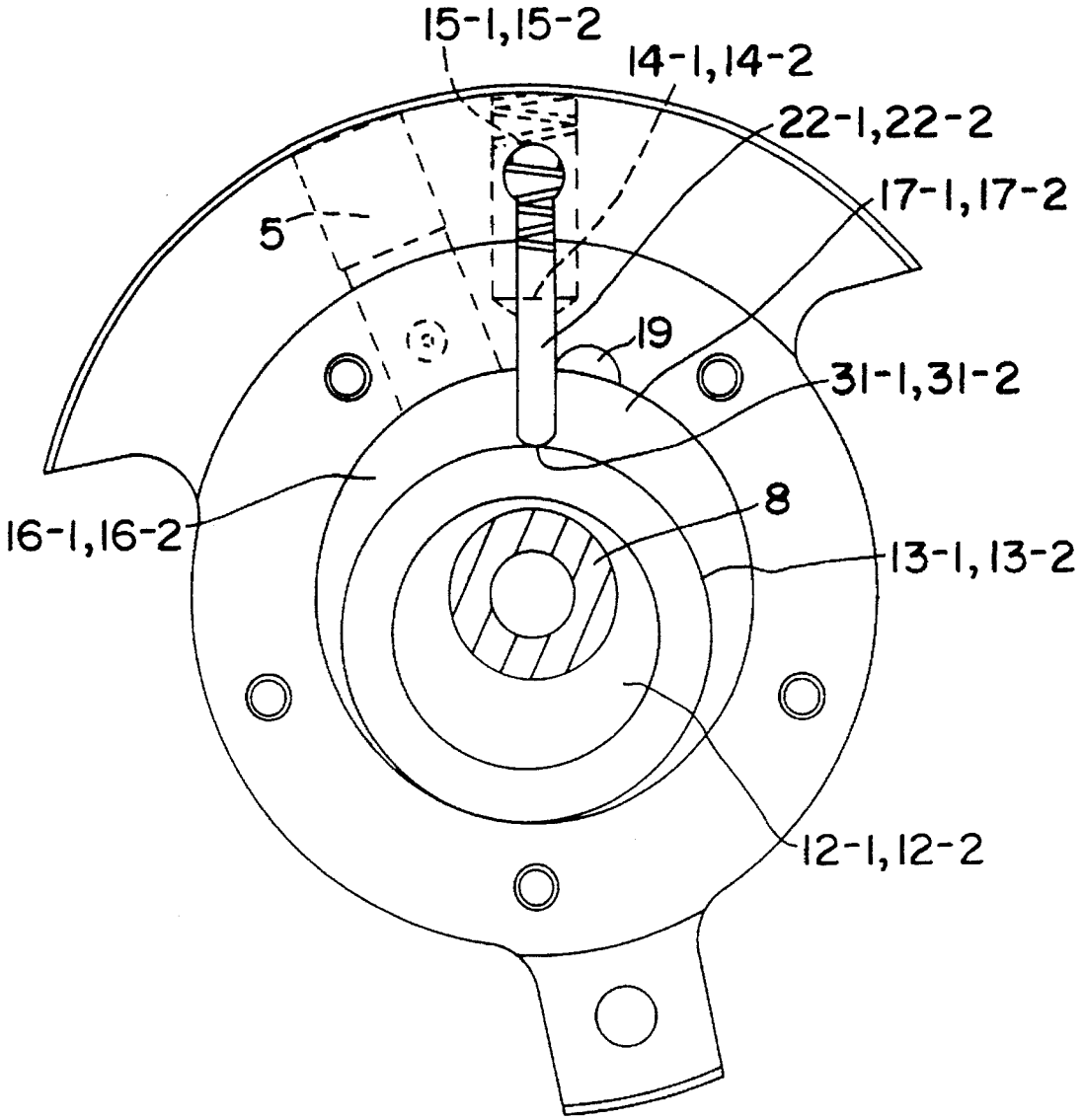
FIG. 8 is a horizontal sectional view, on an enlarged scale, of the compressor of FIG. 5 or 7.

FIGS. 5, 6 and 8 depict a second embodiment of a rotary compressor according to second embodiment of the present invention, in which two rollers are accommodated in associated cylinders to undergo respective planetary motions therein.

The closed rotary compressor shown in FIGS. 5, 6, and 8 includes an electric motor 2 and a compressor mechanism 3 both accommodated in a generally cylindrical sealed vessel 1. A shaft 8, connected directly with the electric motor 2, is carried by a main bearing 9 and an auxiliary bearing 11. The shaft 8 extends through first and second cylinders 10-1 and 10-2 fixed in position inside the sealed vessel 1. The two cylinders 10-1 and 10-2 are separated from each other by a partition plate 40 interposed therebetween. The main bearing 9 is secured to the upper end surface of the second cylinder 10-2, while the auxiliary bearing 11 is secured to the lower end surface of the first cylinder 10-1. First and second cranks (eccentric portions) 12-1 and 12-2 are fixedly mounted on, or otherwise formed integrally with, those portions of the shaft 8 that are situated within the first and second cylinders 10-1 and 10-2, respectively, for rotation together therewith. A ring-shaped first roller 13-1 is operatively positioned between an inner wall surface of the first cylinder 10-1 and an outer peripheral surface of the first crank 12-1 and will, while the shaft 8, undergoes a planetary motion. Likewise, a ring-shaped second roller 13-2 is operatively positioned between an inner wall surface of the second cylinder 10-2 and an outer peripheral surface of the second crank 12-2 and will, while the shaft 8, is driven, undergo a planetary motion.

As best shown in FIG. 8, the first cylinder 10-1 has a radial groove 22-1 defined therein so as to extend in a direction radially thereof, and a slidable radial vane 14-1 is accommodated within the radial groove 22-1 for movement within the radial groove 22-1 in a direction towards and away from the first roller 13-1. This slidable radial vane 14-1 is normally biased by a biasing spring 15-1 and a back pressure (discharge pressure) in one direction with a radially inward end thereof held in sliding contact with an outer peripheral surface of the first roller 13-1, thereby dividing the volume of the first cylinder 10-1 into volumetrically variable, suction and compression chambers 16-1 and 17-1 that are defined, respectively, on leading and trailing sides of the slidable radial vane 14-1 with respect to the direction of rotation of the shaft 8. Likewise, the second cylinder 10-2 has a radial groove 22-2 defined therein so as to extend in a direction radially thereof, and a slidable radial vane 14-2 is accommodated within the radial groove 22-2 for movement within the radial groove 22-2 in a direction towards and away from the second roller 13-2. This slidable radial vane 14-2 is normally biased by a biasing spring 15-2 and a back pressure (discharge pressure) in one direction with a radially inward end thereof held in sliding contact with an outer peripheral surface of the second roller 13-2, thereby dividing the volume of the second cylinder 10-2 into volumetrically variable, suction and compression chambers 16-2 and 17-2 that are defined respectively on leading and trailing sides of the slidable radial vane 14-2 with respect to the direction of rotation of the shaft 8.

A quantity of lubricating oil is accommodated within the sealed vessel 1 at the bottom thereof so that the first cylinder 10-1 may be dipped into the lubricating oil during a normal drive. Mineral oil of naphthene, that of paraffin, or synthetic oil of alkylbenzene is generally used as the lubricating oil in combination with R12 or R22 refrigerant. In the case of the refrigerant of HFC group, oil of the ether group or ester group is used, with which the HFC refrigerant has a solubility. During the normal drive, a considerable quantity of refrigerant is dissolved in the lubricating oil stored at the bottom of the sealed vessel 1 due to the solubility of the former with the latter.

The first cylinder 10-1 has a first intake port 5 defined therein so as to extend radially thereof and is connected to an intake tube 4 received in the first intake port 5. The first cylinder 10-1 communicates with an accumulator (not shown) via the intake tube 4 and the first intake port 5. The first cylinder 10-1 also has a branch port 43 defined therein and branched from the first intake port 5. The branch port 43 communicates with an upper portion of the compressor mechanism 3 by way of a communication hole 41 defined in the partition plate 40 and a second intake port 42 defined in the second cylinder 10-2.

The first intake port 5 communicates with an oil sump 20, formed at the bottom of the sealed vessel 1, via an oil passage 30. As shown in FIGS. 5 and 6, the oil passage 30 is made up of a through-hole 24 defined in the first cylinder 10-1 so as to extend in a direction perpendicular to the direction in which the first intake port 5 extends, a generally cylindrical holder 27 having a throttled portion defined therein, and an oil supply tube 25 encircling the holder 27 and secured to the first cylinder 10-1 at its upper end. The through-hole 24 is positioned upstream of the branch port 43 with respect to the direction of flow of refrigerant. The oil supply tube 25 has a lower end open in the vicinity of the bottom of the sealed vessel 1, and a filter 26 is mounted on the lower end of the oil supply tube 25 to prevent clogging of the throttled portion of the holder 27.

In order to form the throttled portion in the holder 27, a capillary tube 28 is pressed into the holder 27. The capillary tube 28 has a through-hole defined therein which has a diameter less than 1 mm, thus providing a throttling effect. It is possible to form a tiny through-hole directly in the holder 27 instead of pressing the capillary tube into the holder 27. A generally middle portion of the holder 27 is threaded into the through-hole 24 and is carried by the first cylinder 10-1 to provide a sufficient seal therebetween. This construction enables the throttled portion to be disposed in the vicinity of the first intake port 5.

Because the lower open end of the oil supply tube 25 is positioned deep in the oil sump 20, the oil supply tube 25 may be omitted.

Figure 7:
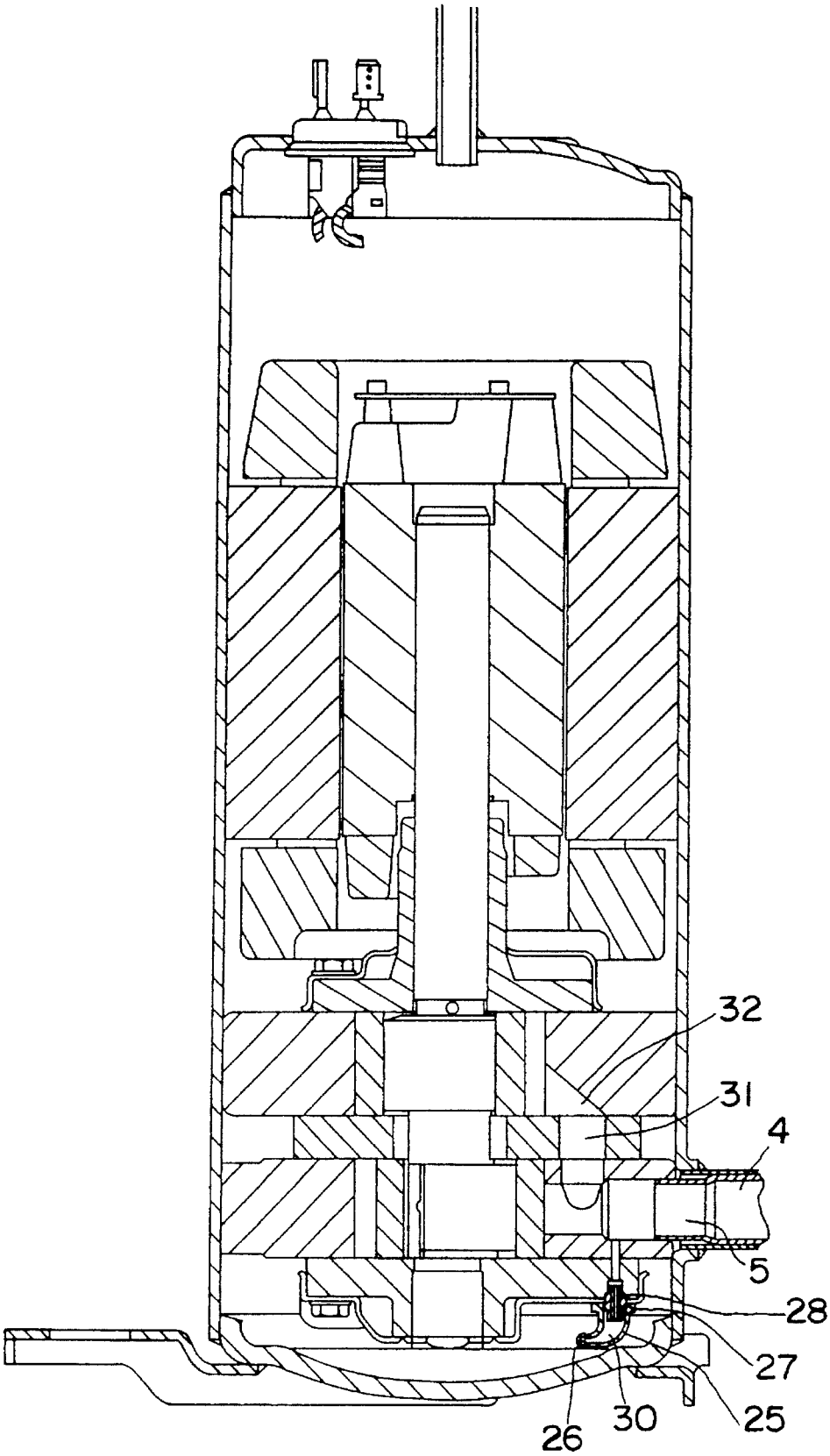
FIG. 7 is a view similar to FIG. 5, but depicting a modification thereof.

FIG. 7 depicts a modification of the embodiment shown in FIGS. 5 and 6. In FIG. 7, the holder 27 having the throttled portion 28 is secured to the auxiliary bearing 11.

The operation of the compressor having the above-described construction is described below.

When the shaft 8 is driven by the electric motor 2, refrigerant gas such as, for example, HFC is introduced into the suction chamber 16-1, through the intake tube 4 and rite first intake port 5, and into the suction chamber 16-2 through the communication hole 41 of the partition plate 40 and the second intake port 42 by the planetary motions of the first and second rollers 13-1 and 13-2. The refrigerant gas is then compressed in the compression chambers 17-1 and 17-2 and is eventually discharged into the sealed vessel 1 via a discharge port 19 and an outlet port 6. At this time, each vane 14-1 (14-2) partitioning the cylinder 10-1 (10-2) into the suction chamber 16-1 (16-2) and the compression chamber 17-1 (17-2) reciprocates within the radial groove 22-1 (22-2) while in sliding contact with the roller 13-1 (13-2) at a region 31-1 (31-2), with the radially inward end of the vane 14-1 (14-2) pressed against the outer peripheral surface of the roller 13-1 (13-2) by the combined force of the biasing spring 15-1 (15-2) and the back pressure acting on the vane 14-1 (14-2). The sliding region 31-1 (31-2) between the radial inner end of the vane 14-1 (14-2) and the roller 13-1 (13-2) is mainly lubricated by a slight amount of lubricating oil which is mixed in the refrigerant being sucked through the first intake port 5. The quantity of the lubricating oil sucked into the suction chamber 16-1 (16-2) of the cylinder 10-1 (10-2) together with the refrigerant is so slight that no sufficient lubrication may be accomplished, and this is particularly true where HFC is employed as the refrigerant to be compressed.

As a matter of course, the internal pressure of the first intake port 5 is low. A pressure difference between the first intake port 5 and the oil sump 20 of a relatively high pressure supplies the lubricating oil to the first intake port 5 through the oil supply tube 25 and the throttled portion, with dust being by the falter 26. Because the lubricating oil stored in the oil sump 20 is properly selected in consideration of the solubility with the refrigerant to be used, a considerable amount of refrigerant is contained in the lubricating oil. Although the lubricating oil containing the refrigerant has a high temperature and pressure in the oil sump 20, the pressure thereof is reduced by the throttled portion, thereby vaporizing the refrigerant. The heat of vaporization generated at that time cools the lubricating oil, which is in turn sucked into the first intake port 5.

As discussed previously, in the conventional oil injector mechanism, the pressure of the lubricating oil is reduced in the capillary tube dipped in the oil sump 20. Accordingly, immediately after the lubricating oil in the capillary tube is cooled, it receives heat from the surrounding high-temperature oil. As a result, oil having the substantially same temperature as the surrounding oil is sucked into the intake port, thus causing overheating of the sucked gas and lowering the efficiency of the compressor.

According to the present invention, however, because the throttled portion is positioned close to the first intake port 5, the oil does not receive heat from its surroundings. Thus, oil having a reduced temperature is introduced into the first intake port 5 and, hence, no reduction in efficiency would occur.

The oil sucked into the first intake port 5 is mixed with the refrigerant gas by the so-called ejector effect. Part of the oil mixed with the refrigerant gas is introduced straightforward into the suction chamber 16-1 and is then transferred to the compression chamber 17-1 by the planetary motion of the first roller 13-1, while the remainder of the oil mixed with the refrigerant gas is introduced into the suction chamber 16-2 through the communication hole 41 and the second intake port 42 and is then transferred to the compression chamber 17-2 by the planetary motion of the second roller 13-2. At this moment, the oil partially reaches the sliding region 31-1 (31-2) between the roller 13-1 (13-2) and the vane 14-1 (14-2), thus forming an oil film to prevent wear thereof.

The oil which has been sucked into the first intake port 5 and has lubricated the sliding elements is discharged, together with the refrigerant gas, into the sealed vessel 1 through the outlet port 6. The oil discharged from the outlet port 6 is thrown off while it passes through cutouts in the electric motor 2, and most of the oil returns to the oil sump 20. In this way, the quantity of the oil which may be circulated through the refrigerating circuit is minimized to avoid any possible reduction in heat exchange efficiency of a heat exchanger while increasing the refrigerating efficiency.

Because the oil sucked into the first intake port 5 passes through the throttled portion, the higher the pressure difference, the more the oil is sucked thereinto. Hence, the higher the pressure difference, the more the lubricating oil is introduced into the sliding regions 31-1 and 3 1-2, accompanied by an increase in reliability.

While in the foregoing description, reference has been made to the use of the HFC refrigerant being compressed, the present invention is not limited to the use of the HFC refrigerant and may be equally applicable to the use of any other conventional refrigerant such as HCFC 22. Even where such conventional refrigerant is employed for the refrigerant being compressed in the rotary compressor, effects similar to those discussed above can be obtained.

Figure 9:
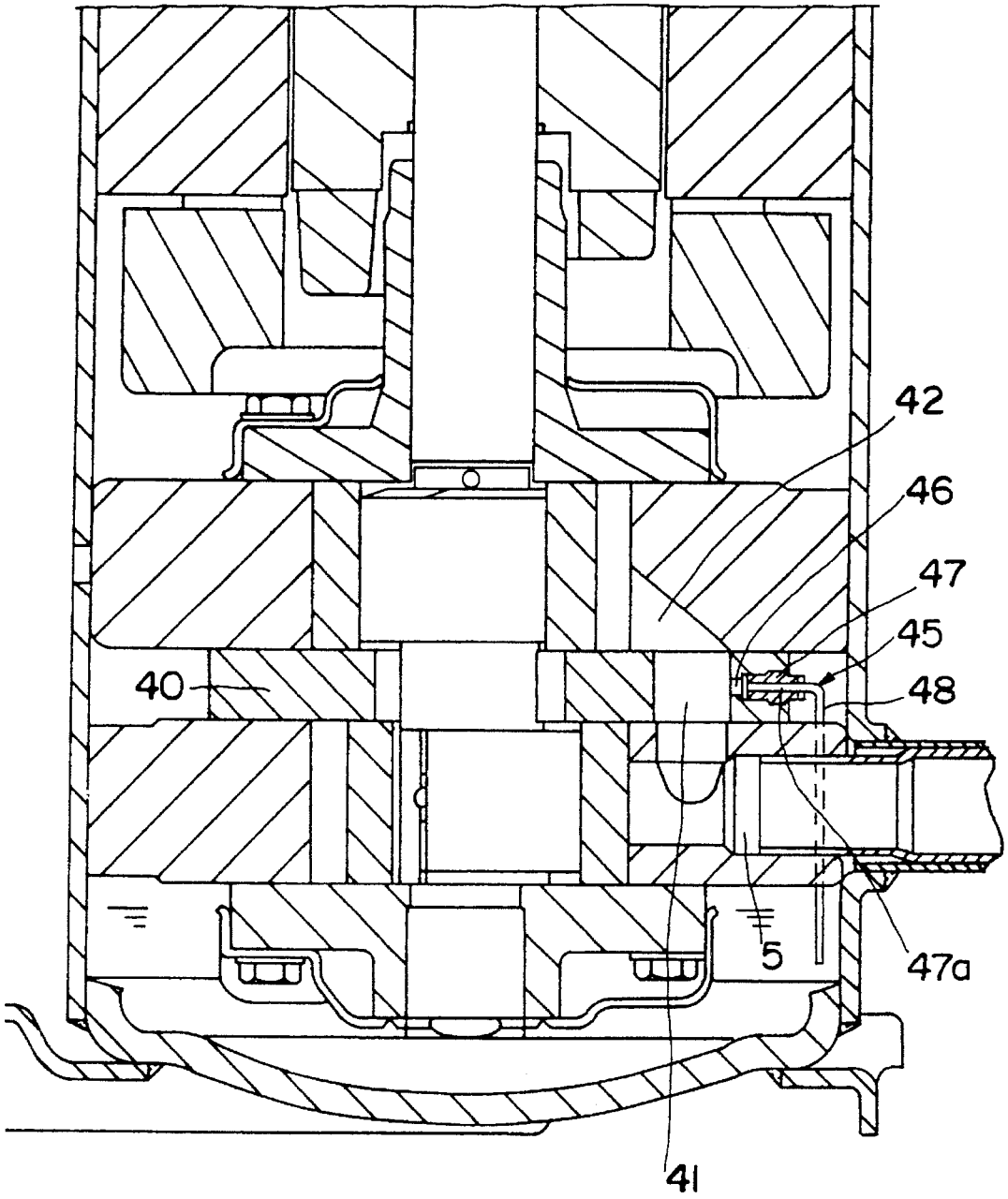
FIG. 9 is a view similar to FIG. 6, but showing a third embodiment of the present invention.
Figure 10:
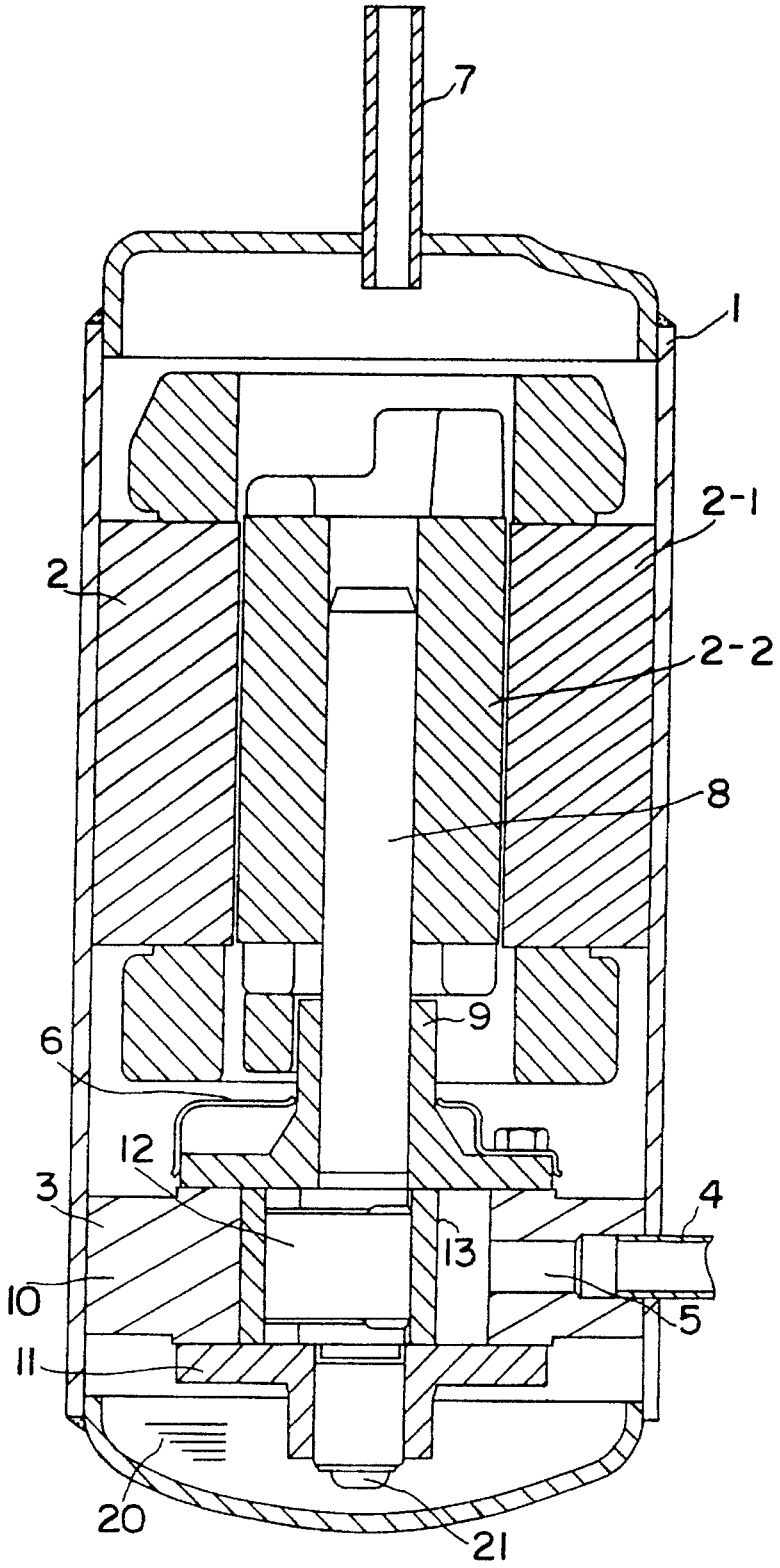
FIG. 10 PRIOR ART
FIG. 10 is a vertical sectional view of a conventional closed rotary compressor of a type accommodating only one roller.
Figure 11:
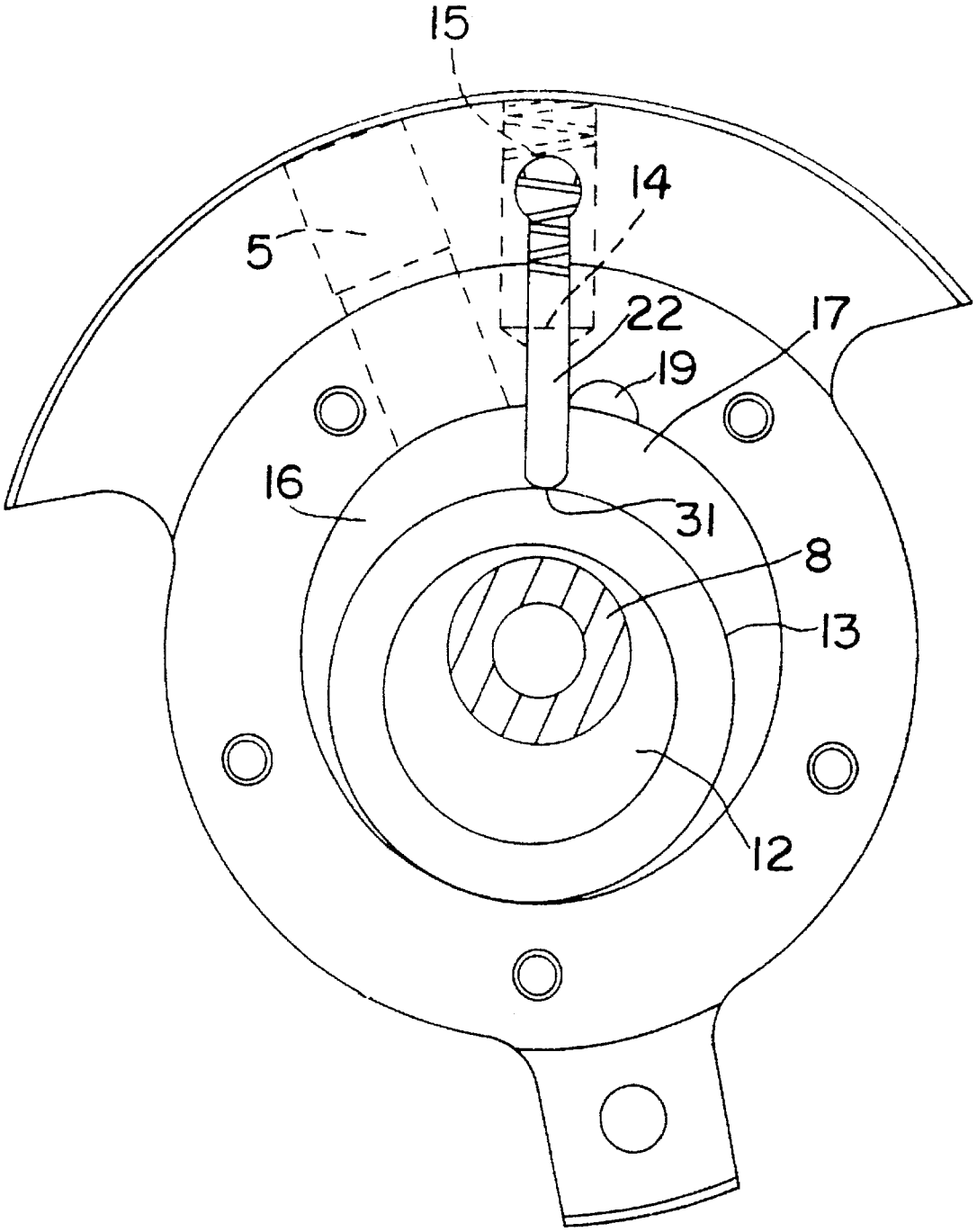
FIG. 11 PRIOR ART
FIG. 11 is a horizontal sectional view, on an enlarged scale, of the compressor of FIG. 10.
Figure 12:
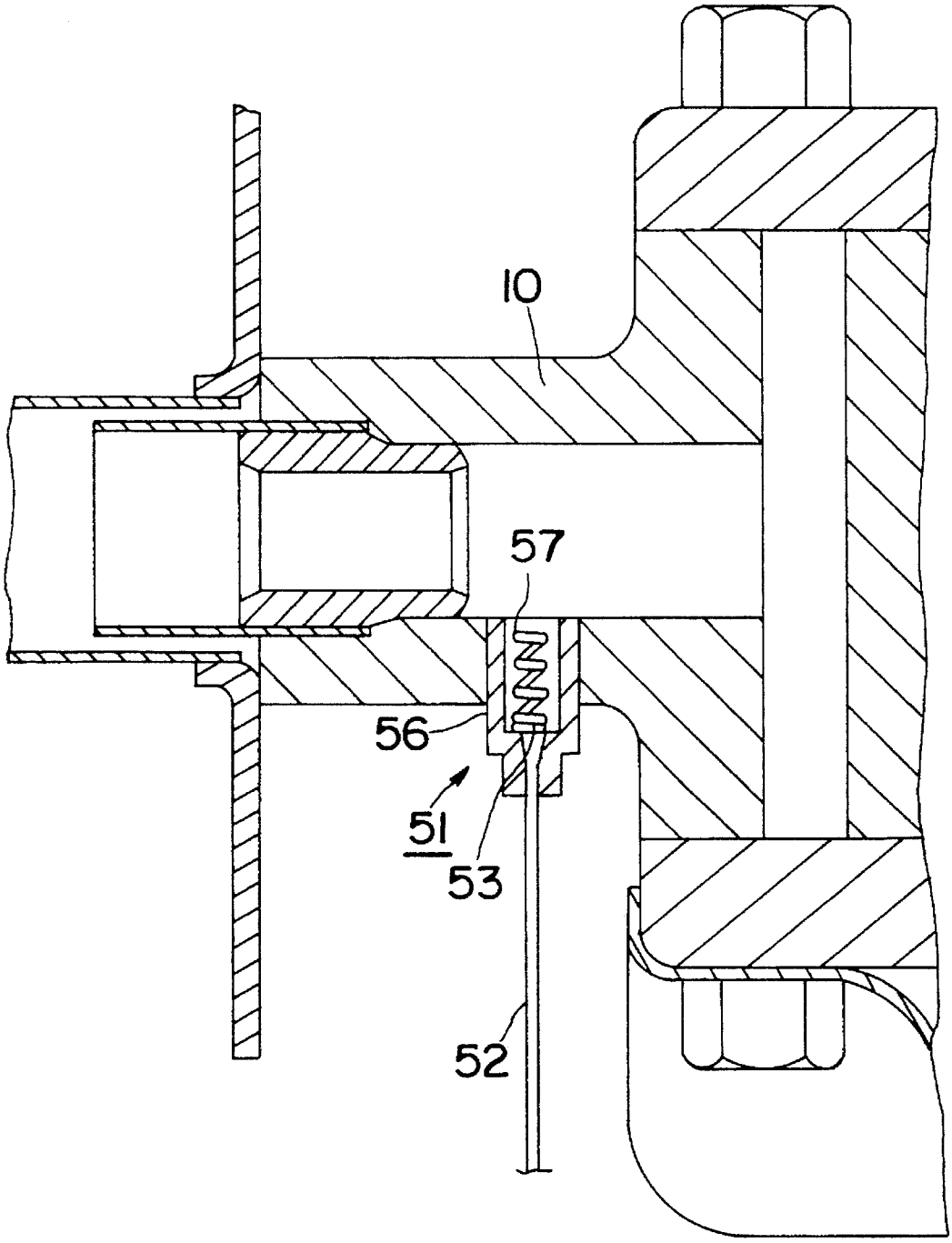
FIG.12 PRIOR ART
FIG. 12 is a vertical sectional view, on an enlarged scale, of another conventional closed rotary compressor, particularly indicating an oil injector mechanism.

FIG. 9 depicts a third embodiment of a closed rotary compressor according to the present invention, in which two rollers are accommodated in associated cylinders to undergo respective planetary motions therein. The closed rotary compressor according to this embodiment differs from that according to the second embodiment in the principle of oil distribution to upper and lower compression elements. The construction of the compression elements and the path of the refrigerant are substantially the same as those shown in FIGS. 5 to 8.

As shown in FIG. 9, the communication hole 41 of the partition plate 40 communicates with the oil sump 20 via an oil passage 45. The oil passage 45 is made up of a through-hole 46 defined in the partition plate 40 radially thereof, a generally cylindrical holder 47 having a throttled portion **47*a* defined therein, and a capillary tube 48 having one end connected to the outer open end of the holder 47 and the other end open in the oil sump 20. A generally middle portion of the holder 47 is threaded into the through-hole 46 and is carried by the partition plate 40** to provide a sufficient seal therebetween.

The presence of a pressure difference between the communication hole 41 of the partition plate 40 and the oil sump 20 introduces the lubricating oil stored in the oil sump 20 to the communication hole 41 through the capillary tube 48 and the throttled portion **47*a* of the holder 47. Because the intake phase of the upper compression elements and that of the lower compression elements differ by 180°, the oil introduced into the communication hole 31 and mixed with the refrigerant is appropriately distributed to the upper and lower compression elements according to the rotational angle of the shaft 8. More specifically, when the force of directing the refrigerant upward is greater than the force tending to direct the refrigerant downward during a period of tinge in which the upper compression elements require more refrigerant than the lower compression elements, most the oil or a considerable amount of oil is introduced to the upper compression elements, along with the refrigerant. In contrast, when the force of directing the refrigerant downward is greater than the force directing the refrigerant upward during a period of time in which the upper compression elements require less refrigerant than the lower compression elements, most of the oil or a considerable amount of oil drops to the first intake port 5** with the gravitational effect added thereto, and is introduced to the lower compression elements, along with the refrigerant.

In accordance with this principle, the lubricating oil is substantially equally distributed to both sets of the compression elements. Accordingly, this embodiment provides effects similar to those obtained in the second embodiment described with reference to FIGS. 5 through 8, accompanied by an increase in reliability.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A closed rotary compressor comprising:

a generally cylindrical sealed vessel having an oil sump defined therein and accommodating a quantity of lubricating oil;

a drive unit housed within said sealed vessel and comprising a drive motor and a shaft driven by said drive motor;

a compressor mechanism housed within said sealed vessel and comprising:

a cylinder having a compression compartment and a refrigerant intake port both defined therein in communication with each other and also having upper and lower end surfaces, first and second bearings secured to the lower and upper end surfaces of said cylinder, respectively, and rotatably supporting said shaft, a crank integral with said shaft so as to rotate together therewith, a ring-shaped roller encircling said crank and capable of undergoing a planetary motion in contact with said crank during rotation of said crank, and a radial vane slidably accommodated in said cylinder so as to be reciprocatable radially of said cylinder, said radial vane having a radial inner end held in sliding contact with an outer peripheral surface of said ring-shaped roller, to thereby divide the compression compartment into a suction chamber and a compression chamber; and oil passage means for placing the oil sump in communication with the refrigerant intake port, said oil passage means comprising a holder secured to said first bearing and having a capillary passage defined therein, said capillary passage defining a throttled portion adjacent to said refrigerant intake port.

2. A closed rotary compressor according to claim 1, wherein said lubricating oil has a solubility with HFC refrigerant.

3. A closed rotary compressor comprising:

a generally cylindrical sealed vessel having an oil sump defined therein and accommodating a quantity of lubricating oil;

a drive unit housed within said sealed vessel and comprising a drive motor and a shaft driven by said drive motor;

a compressor mechanism housed within said sealed vessel and comprising:

a cylinder having a compression compartment and a refrigerant intake port both defined therein in communication with each other and also having upper and lower end surfaces, first and second bearings secured to the lower and upper end surfaces of said cylinder, respectively, and rotatably supporting said shaft, a crank integral with said shaft so as to rotate together therewith, a ring-shaped roller encircling said crank and capable of undergoing a planetary motion in contact with said crank during rotation of said crank, and a radial vane slidably accommodated in said cylinder so as to be reciprocatable radially of said cylinder, said radial vane having a radial inner end held in sliding contact with an outer peripheral surface of said ring-shaped roller, to thereby divide the compression compartment into a suction chamber and a compression chamber; and oil passage means for placing the oil sump in communication with the refrigerant intake port, said oil passage means comprising a holder secured to said cylinder and having a capillary passage defined therein, said capillary passage defining a throttled portion adjacent to said refrigerant intake port.

4. A closed rotary compressor according to claim 3, wherein said lubricating oil has a solubility with HFC refrigerant.

5. A closed rotary compressor comprising:

a generally cylindrical sealed vessel having an oil sump defined therein and accommodating a quantity of lubricating oil;

a drive unit housed within said sealed vessel and comprising a drive motor and a shaft driven by said drive motor;

a compressor mechanism housed within said sealed vessel and having first and second sets of compression elements, each of said first and second sets comprising:

a cylinder having a compression compartment defined therein and also having upper and lower end surfaces, a crank integral with said shaft so as to rotate together therewith, a ring-shaped roller encircling said crank and capable of undergoing a planetary motion in contact with said crank during rotation of said crank, and a radial vane slidably accommodated in said cylinder so as to be reciprocatable radially of said cylinder, said radial vane having a radial inner end held in sliding contact with an outer peripheral surface of said ring-shaped roller, to thereby divide the compression compartment into a suction chamber and a compression chamber;

said ring-shaped rollers of said first and second sets having respective rotational phases which differ by 180°;

said cylinder of said first set having a first refrigerant intake port defined therein in communication with the compression compartment thereof, said cylinder of said first set also having a branch port defined therein and branched from the first refrigerant intake port;

a partition plate interposed between said cylinder of said first set and said cylinder of said second set, said partition plate having a communication hole defined therein in communication with the branch port;

said cylinder of said second set having a second refrigerant intake port defined therein in communication with the communication hole of said partition plate;

first and second bearings secured to the lower end surface of said cylinder of said first set and to the upper end surface of said cylinder of said second set, respectively, and rotatably supporting said shaft; and oil passage means for placing the oil sump in communication with the first refrigerant intake port, said oil passage means being located upstream of the branch port with respect to the direction of flow of refrigerant, and said oil passage means comprising a holder secured to said cylinder of said first set and having a capillary passage defined therein, said capillary passage constituting a throttled portion adjacent to said first refrigerant intake port.

6. A closed rotary compressor according to claim 5, wherein said lubricating oil has a solubility with HFC refrigerant.

7. A closed rotary compressor comprising:

a generally cylindrical sealed vessel having an oil sump defined therein and accommodating a quantity of lubricating oil;

a drive unit housed within said sealed vessel and comprising a drive motor and a shaft driven by said drive motor;

a compressor mechanism housed within said sealed vessel and having first and second sets of compression elements, each of said first and second sets comprising:

a cylinder having a compression compartment defined therein and also having upper and lower end surfaces, a crank integral with said shaft so as to rotate together therewith, a ring-shaped roller encircling said crank and capable of undergoing a planetary motion in contact with said crank during rotation of said crank, and a radial vane slidably accommodated in said cylinder so as to be reciprocatable radially of said cylinder, said radial vane having a radial inner end held in sliding contact with an outer peripheral surface of said ring-shaped roller, to thereby divide the compression compartment into a suction chamber and a compression chamber;

said ring-shaped rollers of said first and second sets having respective rotational phases which differ by 180°;

said cylinder of said first set having a first refrigerant intake port defined therein in communication with the compression compartment thereof, said cylinder of said first set also having a branch port defined therein and branched from the first refrigerant intake port;

a partition plate interposed between said cylinder of said first set and said cylinder of said second set, said partition plate having a communication hole defined therein in communication with the branch port;

said cylinder of said second set having a second refrigerant intake port defined therein in communication with the communication hole of said partition plate;

first and second bearings secured to the lower end surface of said cylinder of said first set and to the upper end surface of said cylinder of said second set, respectively, and rotatably supporting said shaft; and oil passage means for placing the oil sump in communication with the first refrigerant intake port, said oil passage means being located upstream of the branch port with respect to the direction of flow of refrigerant, and said oil passage means comprising a holder secured to said first bearing and having a capillary passage defined therein, said capillary passage constituting a throttled portion adjacent to said first refrigerant intake port.

8. A closed rotary compressor according to claim 7, wherein said lubricating oil has a solubility with HFC refrigerant.

9. A closed rotary compressor comprising:

a generally cylindrical sealed vessel having an oil sump defined therein and accommodating a quantity of lubricating oil;

a drive unit housed within said sealed vessel and comprising a drive motor and a shaft driven by said drive motor;

a compressor mechanism housed within said sealed vessel and having first and second sets of compression elements, each of said first and second sets comprising:

a cylinder having a compression compartment defined therein and also having upper and lower end surfaces, a crank integral with said shaft so as to rotate together therewith, a ring-shaped roller encircling said crank and capable of undergoing a planetary motion in contact with said crank during rotation of said crank; and a radial vane slidably accommodated in said cylinder so as to be reciprocatable radially of said cylinder, said radial vane having a radial inner end held in sliding contact with an outer peripheral surface of said ring-shaped roller, to thereby divide the compression compartment into a suction chamber and a compression chamber;

said ring-shaped rollers of said first and second sets having respective rotational phases which differ by 180°;

said cylinder of said first set having a first refrigerant intake port defined therein in communication with the compression compartment thereof, said cylinder of said first set also having a branch port defined therein and branched from the first refrigerant intake port;

a partition plate interposed between said cylinder of said first set and said cylinder of said second set, said partition plate having a communication hole defined therein in communication with the branch port;

said cylinder of said second set having a second refrigerant intake port defined therein in communication with the communication hole of said partition plate;

first and second bearings secured to the lower end surface of said cylinder of said first set and to the upper end surface of said cylinder of said second set, respectively, and rotatably supporting said shaft; and oil passage means secured to said partition plate for placing the oil sump in communication with the communication hole.

10. The closed rotary compressor according to claim 9, wherein said oil passage means has a throttled portion adjacent to the communication hole.

11. The closed rotary compressor according to claim 9, wherein said oil passage means comprises a holder secured to said partition plate and having a capillary passage defined therein, said capillary passage constituting the throttled portion.

12. The closed rotary compressor according to claim 9, wherein said lubricating oil has a solubility with HFC refrigerant.

* * * * *